US007884534B2

(12) United States Patent
Murakami et al.

(10) Patent No.: US 7,884,534 B2
(45) Date of Patent: Feb. 8, 2011

(54) DISPLAY PANEL AND MANUFACTURING METHOD OF THE DISPLAY PANEL

(75) Inventors: Shigenori Murakami, Chuo (JP); Akinao Adachi, Chuo (JP); Kiyoshi Shimomura, Chuo (JP)

(73) Assignee: Panasonic Corporation, Kadoma-shi (JP)

( * ) Notice: Subject to any disclaimer, the term of this patent is extended or adjusted under 35 U.S.C. 154(b) by 314 days.

(21) Appl. No.: 11/907,764

(22) Filed: Oct. 17, 2007

(65) Prior Publication Data

US 2008/0143236 A1 Jun. 19, 2008

(30) Foreign Application Priority Data

Dec. 19, 2006 (JP) ..... 2006-341594

(51) Int. Cl.
*H01J 1/62* (2006.01)
*H01J 9/02* (2006.01)

(52) U.S. Cl. ..... 313/484; 313/582; 313/585; 313/587

(58) Field of Classification Search ..... 313/582–587, 313/484; 315/169.3, 169.4; 345/60, 30, 345/37; 445/24
See application file for complete search history.

(56) References Cited

U.S. PATENT DOCUMENTS

| | | | | |
|---|---|---|---|---|
| 6,184,621 | B1 * | 2/2001 | Horiuchi et al. | 313/586 |
| 2004/0000873 | A1 * | 1/2004 | Moon | 313/587 |
| 2004/0201351 | A1 * | 10/2004 | Woo et al. | 313/582 |
| 2005/0104519 | A1 * | 5/2005 | Jeon | 313/582 |
| 2006/0061278 | A1 * | 3/2006 | Jung et al. | 313/582 |
| 2006/0202619 | A1 * | 9/2006 | Kim | 313/582 |

FOREIGN PATENT DOCUMENTS

JP 2679036 8/1997

* cited by examiner

*Primary Examiner*—Bumsuk Won
*Assistant Examiner*—Elmito Breval
(74) *Attorney, Agent, or Firm*—Kratz, Quintos & Hanson, LLP

(57) ABSTRACT

In a PDP, an end of a first partition (124) is provided with a partition end 126 whose height dimension and width dimension are smaller than those of the first partition (124). With this arrangement, when a nozzle is moved from a portion between the partition ends (126) on a first side to a portion between the partition ends (126) on a second side in a phosphor layer forming step for forming a phosphor layer, a phosphor paste can be uniformly applied to recessed portions (123A), thereby easily providing the PDP that includes the phosphor layer with which good images can be realized.

5 Claims, 13 Drawing Sheets

DISPLAY PANEL AND MANUFACTURING METHOD OF THE DISPLAY PANEL

BACKGROUND OF THE INVENTION

1. Field of the Invention

The present invention relates to a display panel and a manufacturing method of the display panel.

2. Description of Related Art

Conventionally, a plasma display panel (PDP) has been configured by: disposing a pair of planar substrates to face each other with a discharge space interposed therebetween; partitioning the discharge space into a plurality of discharge cells by providing a curb-shaped or striped partition on an inner surface of one of substrates; and providing the partitioned portions with phosphor layers exemplarily of red, blue and green. The PDP displays images by selectively discharging inside the discharge cells for light emitting. As a method for forming the phosphor layer in the PDP, there has been know an ink-jet method, with which a phosphor material is injected to between the partitions using, for example, a nozzle (e.g. see Document: Japanese Patent No. 2679036).

According to the method disclosed in Document, a substrate to which partitions are preliminarily processed to be mounted is fixed to a mounting base, and an injection head is moved on a scanning mechanism. Then, the injection head is paused at a position corresponding to a pixel position, such that phosphor liquid is dribbled or injected by the nozzle, thereby forming a phosphor layer.

However, the arrangement according to Document, in which the injection head moved on the scanning mechanism is paused at a predetermined pixel poison to dribble or inject the phosphor liquid, requires a control program for pausing the injection head at the pixel position. In addition, with this arrangement, an operation for applying the phosphor takes more time. Further, when the injection head is misaligned with the pixel position, the phosphor may not be suitably applied.

In contrast, there is a method for forming the phosphor layer, according to which the phosphor is applied while the injection head is moved along the partitions at a constant speed. However, with this arrangement, when the injection head is moved to an end of the substrate (a non-display area in the PDP), an amount of the injected phosphor is increased due to a decrease in the speed of the injection head, whereby a phenomenon in which the phosphor is applied on the partitions (i.e., the phosphor is applied on a top side of the partition) can be caused. When the phosphor is applied on the partitions, a gap may be formed between the pair of substrates disposed to face each other at the center of the substrate (a display area in the PDP) when a cover substrate is mounted to face the substrate, whereby a noise can be generated by a resonance due to discharge.

SUMMARY OF THE INVENTION

In light of the above-described problems, an object of the present invention is to provide a display panel that realizes good images and a manufacturing method for the display panel.

A display panel according to an aspect of the present invention includes: a pair of substrates disposed to face each other with a discharge space being interposed; partitions that partition the discharge space into display cells, the partitions being provided to at least one of the pair of substrates to be longitudinally formed between ends of the at least one of the pair of substrates; and a phosphor layer that emits light due to discharge in the discharge space, the phosphor layer being formed between the partitions, in which a display area in which images are displayed by light emitting of the phosphor layer due to the discharge is provided in an in-plane side of the at least one of the substrates while a non-display area is provided at a peripheral end of the at least one of the substrates, an end of each of the partitions provided at positions corresponding to the non-display area has a shape that is different from a shape of the partitions provided at positions corresponding to the display area, and an end of the phosphor layer is formed between the ends of the partitions provided at the positions corresponding to the non-display area.

A manufacturing method of a display panel according to another aspect of the present invention includes a partition forming step to provide partitions that partition a discharge space into display cells to at least one of a pair of substrates disposed to face each other with the discharge space being interposed, the partitions being longitudinally formed between ends of at least one of the pair of substrates; and a phosphor layer forming step to provide a phosphor layer between the partitions provided in the partition forming step, in which a display area in which images are displayed by light emitting of the phosphor layer due to discharge is provided in an in-plane side of the at least one of the substrates while a non-display area is provided at a peripheral end of the at least one of the substrates, the non-display area including a first non-display area and a second display area that are disposed with the display area being interposed, in the partition forming step, ends of the partitions provided at positions respectively corresponding to the first and second non-display areas are formed to have a shape that is different from a shape of the partitions provided at positions corresponding to the display area, and in the phosphor layer forming step, an operation of applying a phosphor paste is started using a nozzle at between the ends of the partitions provided at positions corresponding to the first non-display area while the operation of applying the phosphor paste is terminated at between the ends of the partitions provided at positions corresponding to the second non-display area.

DETAILED DESCRIPTION OF PREFERRED EMBODIMENT(S)

A first embodiment of the present invention will be described below with reference to the attached drawings.

[Arrangement of PDP]

Figure 1:
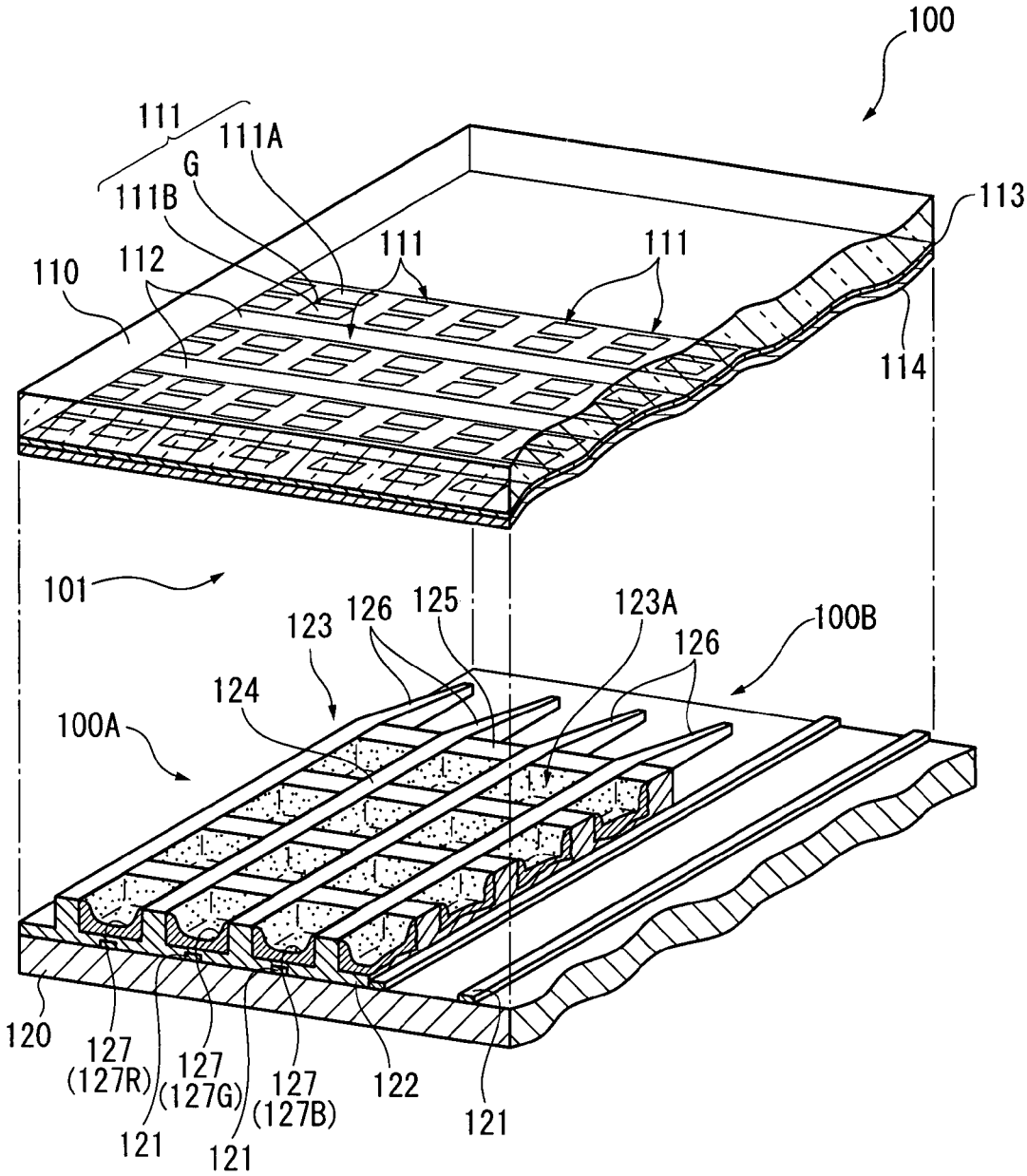
FIG. 1 is a perspective view showing a substrate of a plasma display panel according to a first embodiment of the present invention.
Figure 2:
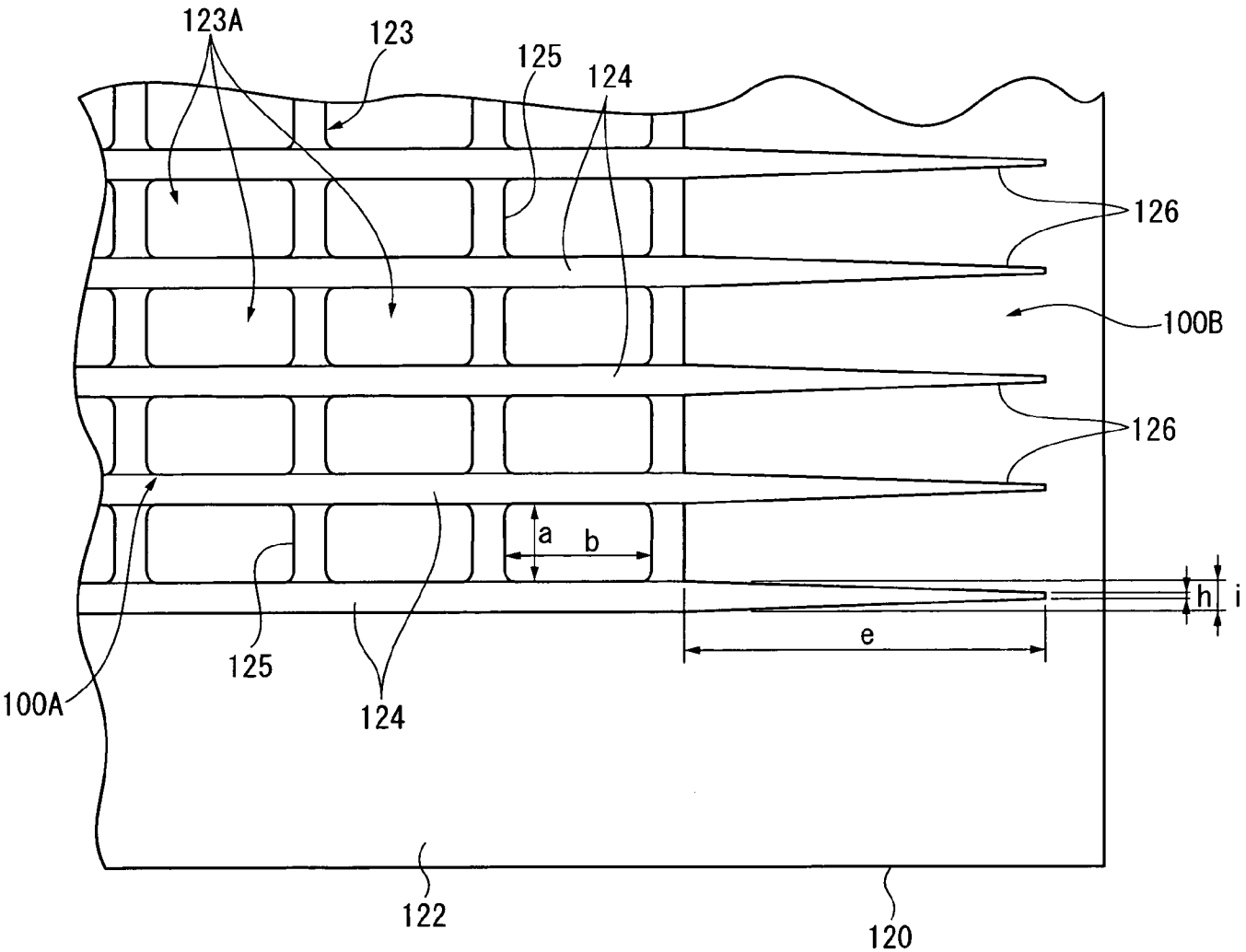
FIG. 2 is a plan view showing a vicinity of an end of a rear substrate according to the first embodiment.
Figure 3:
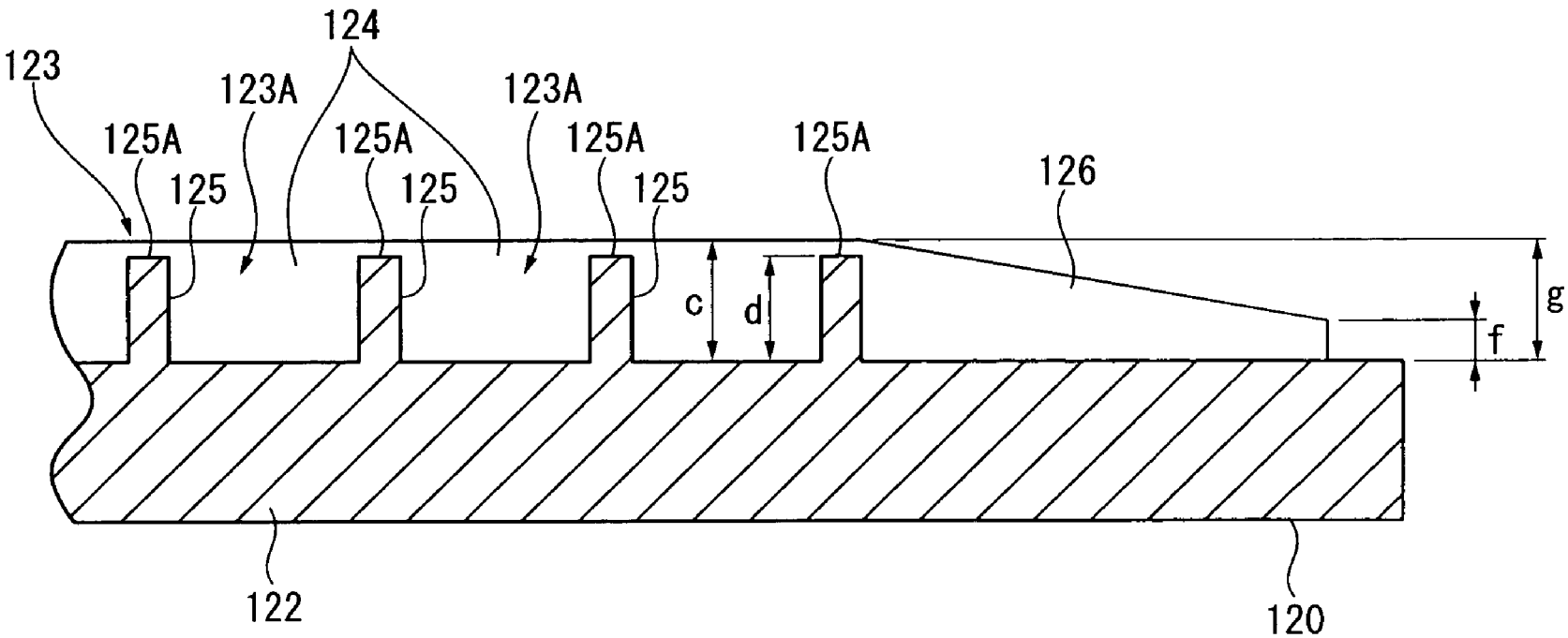
FIG. 3 is a cross-sectional view showing the vicinity of the end of the rear substrate according to the first embodiment.
Figure 4:
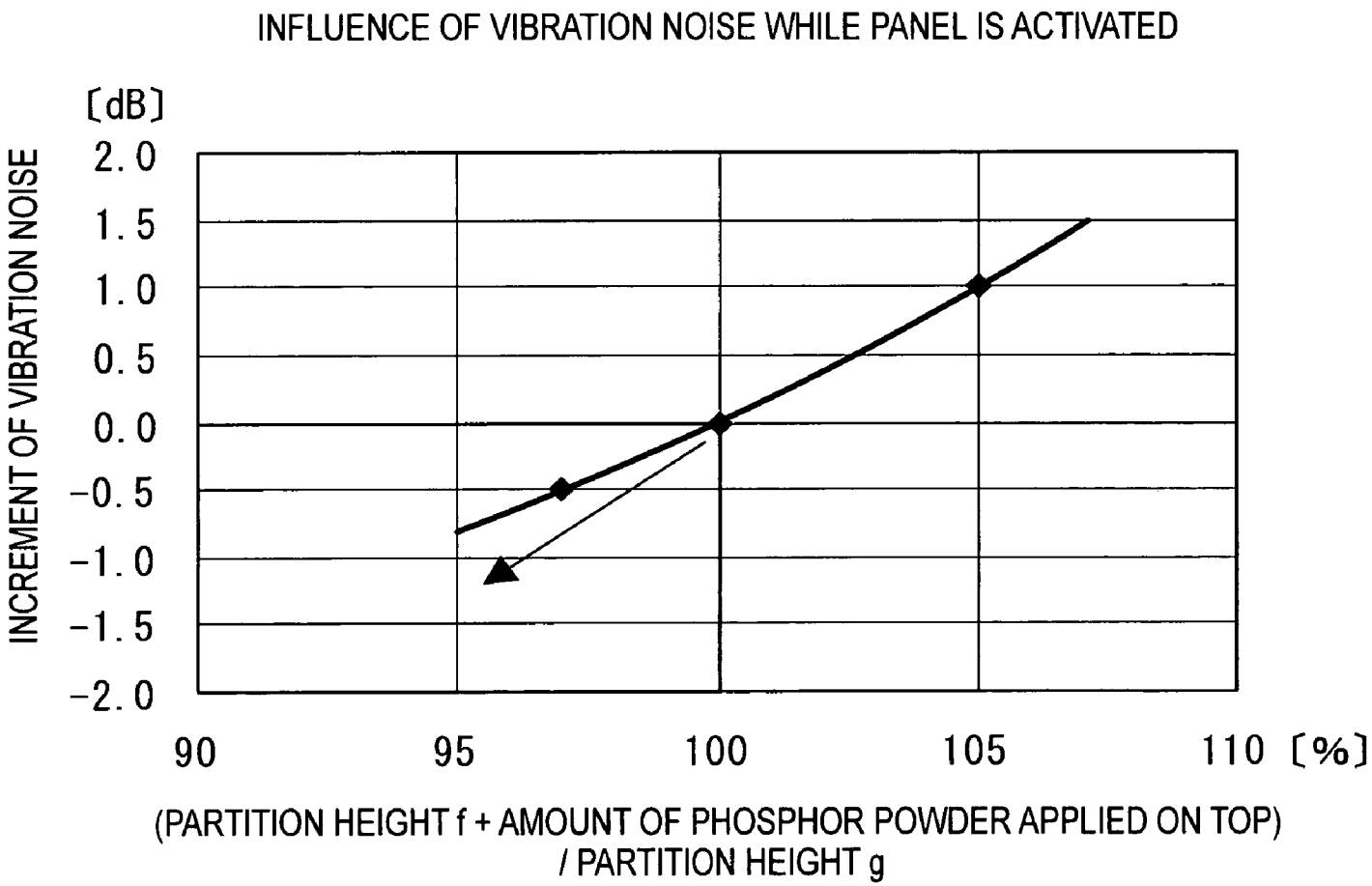
FIG. 4 is a graph showing an influence of a vibration noise while the panel is activated according to the first embodiment.
Figure 5:
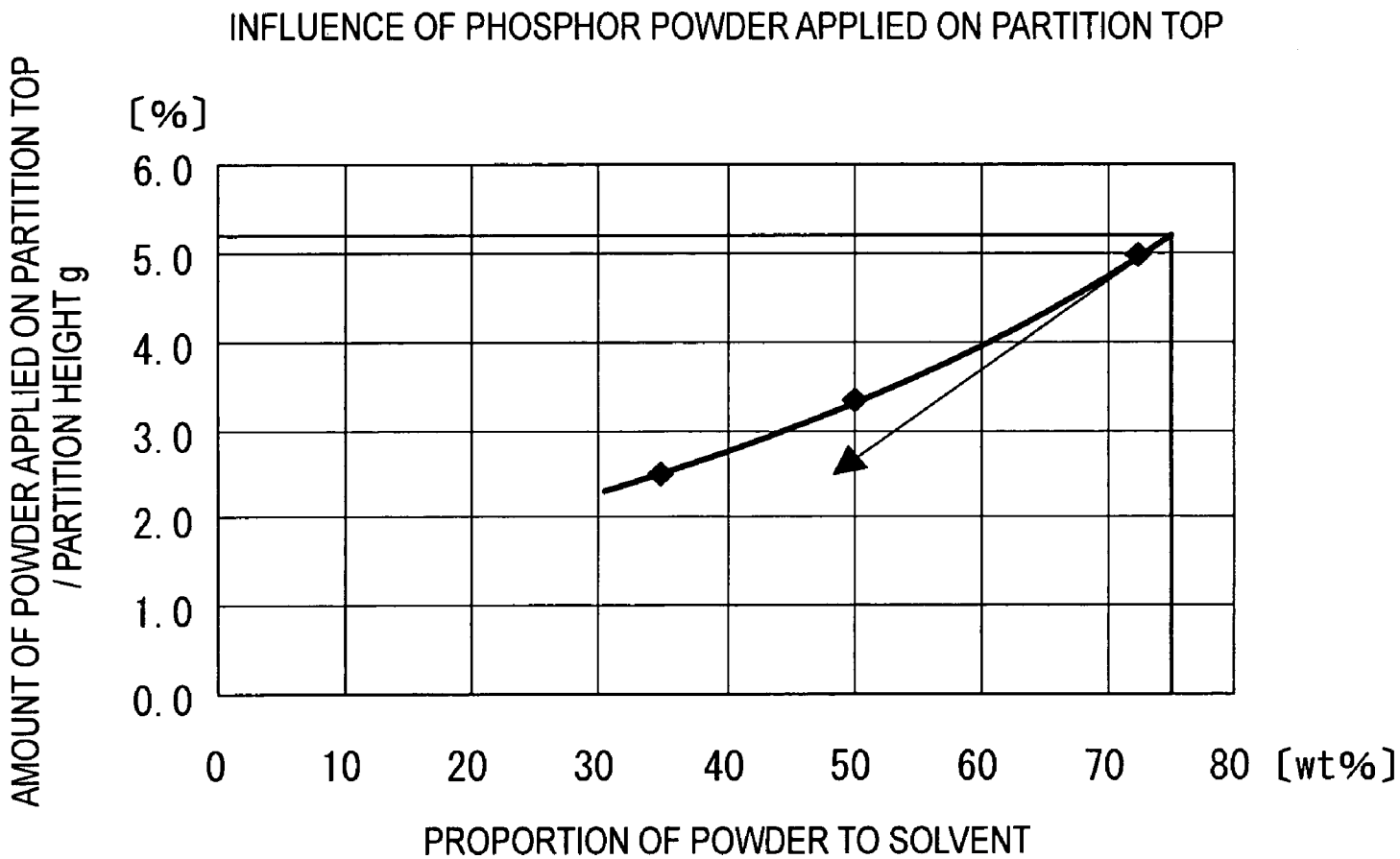
FIG. 5 is a graph showing an influence of phosphor powder applied on a top side according to the first embodiment.

FIG. 1 is a perspective view showing a substrate of a plasma display panel according to the first embodiment of the present invention. FIG. 2 is a plan view showing a vicinity of an end of a rear substrate according to the first embodiment. FIG. 3 is a cross-sectional view showing the vicinity of the end of the rear substrate according to the first embodiment. Incidentally, in the drawings, a dimension of a partition and a dimension of a recessed portion of a molding die are enlarged relative to the substrate for convenience of explanation and illustration, and the numbers of the partitions and the recessed portions are significantly underrepresented. FIG. 4 is a graph showing an influence of a vibration noise while the panel is activated. FIG. 5 is a graph showing an influence of phosphor powder applied on a top side.

In FIG. 1, the numeral 100 refers to a plasma display panel serving as a display panel, and the plasma display panel (PDP) 100 is shaped in a substantially rectangular plate. In an in-plane side of the PDP 100, a display area 100A that emits light due to discharge to display a predetermined image is provided. At a peripheral end of the display area 100A in an out-of-plane direction, a non-display area where no image is displayed is provided.

As shown in FIG. 1, in the PDP 100, a front substrate 110 and a rear substrate 120 are disposed to face each other with a discharge space provided therebetween.

In an inner side of the front substrate 110, a plurality of display electrodes 111, a plurality of black stripes 112, a dielectric layer 113 and a protective layer 114 are provided.

Specifically, the display electrode 111 includes: plural pairs of transparent electrodes 111A, 111B that face each other with a discharge gap G therebetween; and a pair of linear bus electrodes (not shown) laminated on one ends of the transparent electrodes 111A, 111B. The transparent electrodes 111A, 111B are each a transparent conductive film that is formed of, for example, ITO (Indium Tin Oxide) or the like, and each pair of transparent electrodes 111A, 111B is provided to correspond to a discharge cell serving as a predetermined display cell.

The bus electrodes, which are linearly formed of, for example, Ag (silver) or the like, are laminated on the ends of the pair of transparent electrodes 111A, 111B, the ends being on sides opposite to the discharge gap G. One ends of the bus electrodes are provided with bus electrode leading portions (not shown), through which a voltage pulse from a row electrode driver (not shown) is applied to the transparent electrodes 111A, 111B.

The black stripe 112 is linearly formed of, for example, a black inorganic pigment or the like. The black stripe 112 absorbs visible light irradiated from the outside of the front substrate 110.

The dielectric layer 113, which is formed of, for example, a dielectric paste or the like, is arranged to face an address-electrode dielectric layer 122 of the rear substrate 120. When the panel is driven, the dielectric layer 113 prevents the display electrodes 12 from being damaged by the discharge panel and accumulates electric charges required for the drive.

The protective layer 114, which is a transparent layer that is formed of MgO (magnesium oxide) by vapor deposition, sputtering or the like, covers the entire inner surface of the dielectric layer 113. The protective layer 114 prevents the dielectric layer 113 from being sputtered due to the discharge while serving as a discharge layer of a secondary electron for generating the discharge at a low voltage.

The rear substrate 120, which is a rectangular glass plate, includes address electrodes 121, the address-electrode dielectric layers 122, partition layers 123, phosphor layers 127 and the like.

The address electrode 121 is provided in plurality in parallel to, for example, a width direction of the rear substrate 120, thereby forming zonal patterns. The address electrode 121 is formed of, for example, a thin film of Aluminum (Al) by photolithography or the like. In addition, both ends of the address electrode 121 are provided with a leading electrode (not shown) for guiding a predetermined signal to the address electrode 121, the leading electrode being drawn outward from an end periphery of the address-electrode dielectric layer 122.

The address-electrode dielectric layer 122 is formed exemplarily of glass paste to protect the address electrode 121. The address-electrode dielectric layer 122 is provided on the inner side of the rear substrate 120 to cover the address electrode 121.

The partition layer 123 is formed exemplarily of the glass paste containing the same components as the glass paste forming the address-electrode dielectric layer 122 and provided on a surface facing the front substrate 110. As shown in FIGS. 1 and 2, the partition layer 123 includes: a first partition 124 provided substantially along the width direction (a first direction) of the PDP 100; and a second partition 125 provided substantially along a height direction (a second direction), which is perpendicular to the width direction. A recessed portion 123A is defined by the first partitions 124 and the second partitions 125.

The recessed portion 123A houses the discharge cell therein. The recessed portion 123A, whose column width a and transverse width b are set to have desired values (i.e., values corresponding to the discharge cell in the PDP 100), is located on the address electrode 121.

In addition, as shown in FIG. 3, a part of the second partition 125 bridging between the first partitions 124 is provided with a low wall portion 125A whose height dimension d from the surface of the address-electrode dielectric layer 122 is set to be smaller than a height dimension c of the first partition 124 from the surface of the address-electrode dielectric layer 122. The low wall portion 125A may be provided to a part of a portion between the first partitions 124 or may be provided to the entirety of the portion between the first partitions 124.

At a position facing the non-display area 100B of the PDP 100 on an end side of the first partition 124, a partition end 126 is provided as shown in FIGS. 1 to 3.

The partition end 126 is formed on an extension of the first partition 124 to longitudinally extend substantially along the width direction of the PDP 100. A longitudinal length dimension e of the end partition 126 is set to be larger than the transverse width b of the recessed portion 123A. When the longitudinal length dimension e of the end partition 126 is smaller than the transverse width b of the recessed portion 123A, a stability of a phosphor paste applied in the phosphor layer forming step for forming a later-described phosphor layer 127 may be deteriorated. On the other hand, by setting the length dimension e of the partition end 126 to be larger than the transverse width b of the recessed portion 123A, the phosphor paste can be stably applied to the recessed portion 123A.

The partition end 126 is formed to reduce a height dimension from the address-electrode dielectric layer 122 as extending from the in-plane direction of the rear substrate 120 toward the out-of-plane direction.

Specifically, a height dimension f of an out-of-plane directional end of the partition end 126 is preferably set to be 94.8 percent or less of a height dimension g of an in-plane directional end.

When the height dimension f of the out-of-plane directional end of the partition end 126 is set to be more than 94.8 percent of the height dimension g (the height dimension of the first partition) of the in-plane directional end, the phosphor paste may be applied on a top side of the partition end 126 in the later-described phosphor layer forming step, such that phosphor powder is placed on the top side of the partition end 126 by calcination. In that case, the height dimension of the partition end 126 may become higher than the height dimension g of the in-plane directional end of the partition end 126. In that case, as shown in FIG. 4, in the display area 100A of the PDP 100, a gap corresponding to the height of the phosphor paste applied on the top side of the partition end 126 may be formed, whereby a resonance may be caused to generate a noise.

In contrast, when the height dimension f of the out-of-plane directional end of the partition end 126 is 94.8 percent or less of the height dimension g of the in-plane directional end, a gap is formed between the front substrate 110 and the partition end 126 even when the phosphor paste is applied on the top side of the partition end 126, whereby no gap is formed in the display area 100A of the PDP 100. Particularly, the phosphor paste for forming the phosphor layer 127 is generally formed such that a proportion of the phosphor powder to a solvent is 75 percent or less. Even when the phosphor paste whose phosphor powder proportion is 75 percent is applied on the top side of the partition end 126, the height dimension of the partition end 126 does not become larger than the height dimension g of the first partition 124 as long as the height dimension f of the out-of-plane direction end of the partition end 126 is 94.8 percent or less of the height dimension g of the in-place directional end. Accordingly, a stable phosphor layer can be formed.

The partition end 126 is formed to reduce a dimension of a width that is substantially perpendicular to the width direction of the PDP 100 toward the out-of-plane direction from the in-plane direction.

Specifically, a width dimension h of the out-of-plane directional end of the partition end 126 is preferably set to be 90 percent or less of a width dimension i (a width dimension of the first partition) of the in-plane directional end.

When the width dimension h of the out-of-plane directional end of the partition end 126 is set to be more than 90 percent of the width dimension i of the in-plane directional end, the phosphor paste may be applied on the top side of the partition end 126. Specifically, in a phosphor applying step, a nozzle injects to apply the phosphor paste to the substrate while being moved along the longitudinal direction of the first partition 124 from a first end of the first partition to a second end of the first partition at a constant speed. Since the speed of the nozzle is decreased when the application of the phosphor paste is started and terminated, the phosphor paste may be injected in an amount more than a predetermined amount at such times. Thus, the phosphor paste may be applied on the top side of the partition end 126. When the phosphor paste is applied on the top side of the partition end 126 in the amount more than the predetermined amount, the gap may be formed in the display area 100A of the PDP 100, whereby a noise may be generated due to the resonance, as described above.

On the other hand, when the width dimension h of the out-of-plane directional end of the partition end 126 is set to be 90 percent or less of the width dimension i of the in-plane directional end, the phosphor paste does not protrude onto the top side of the partition end 126 in the phosphor layer forming step, whereby the stable phosphor layer can be formed.

As shown in FIG. 1, the phosphor layer 127 is continuously provided between the neighboring first partitions 124 to longitudinally extend along the longitudinal direction of the first partition 124 (the width dimension of the PDP 100).

Specifically, the phosphor layer 127 includes a red phosphor layer 127R, a green phosphor layer 127G and a blue phosphor layer 127B. As shown in FIG. 1, each of the phosphor layers 127R, 127G, 127B is allayed in plurality in the longitudinal direction of the second partition 125 in the order of the red phosphor layer 127R, the green phosphor layer 127G and the blue phosphor layer 127B. The phosphor layers 127R, 127G, 127B are continuously provided along a line between the first partitions 124. The phosphor layer 127 is provided to be located between the partition ends 126 whose end neighbors each other.

[Manufacturing Method of PDP]

Next, a manufacturing method of the above-described PDP 100 will be described.

Figure 6:
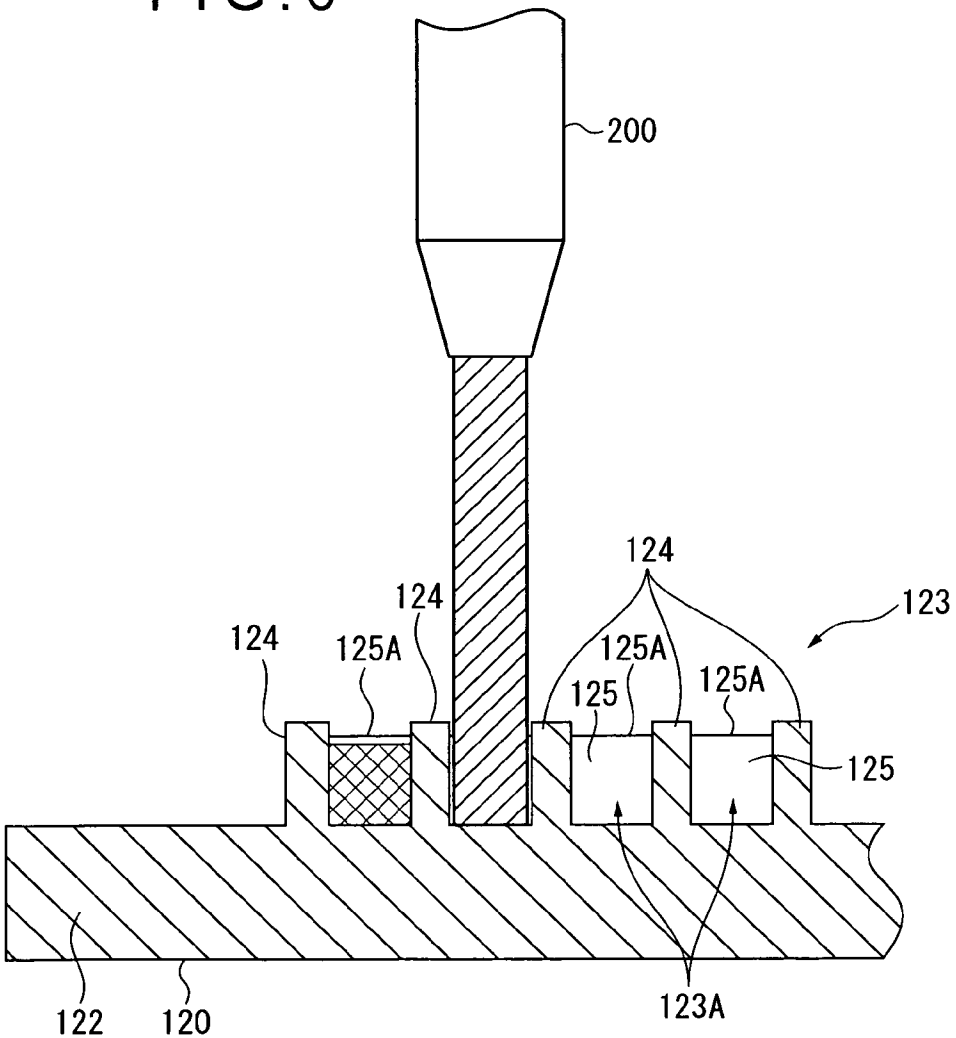
FIG. 6 is a cross-sectional view schematically showing a nozzle for injecting phosphor paste and the rear substrate during a phosphor layer forming step according to the first embodiment.
Figure 7:
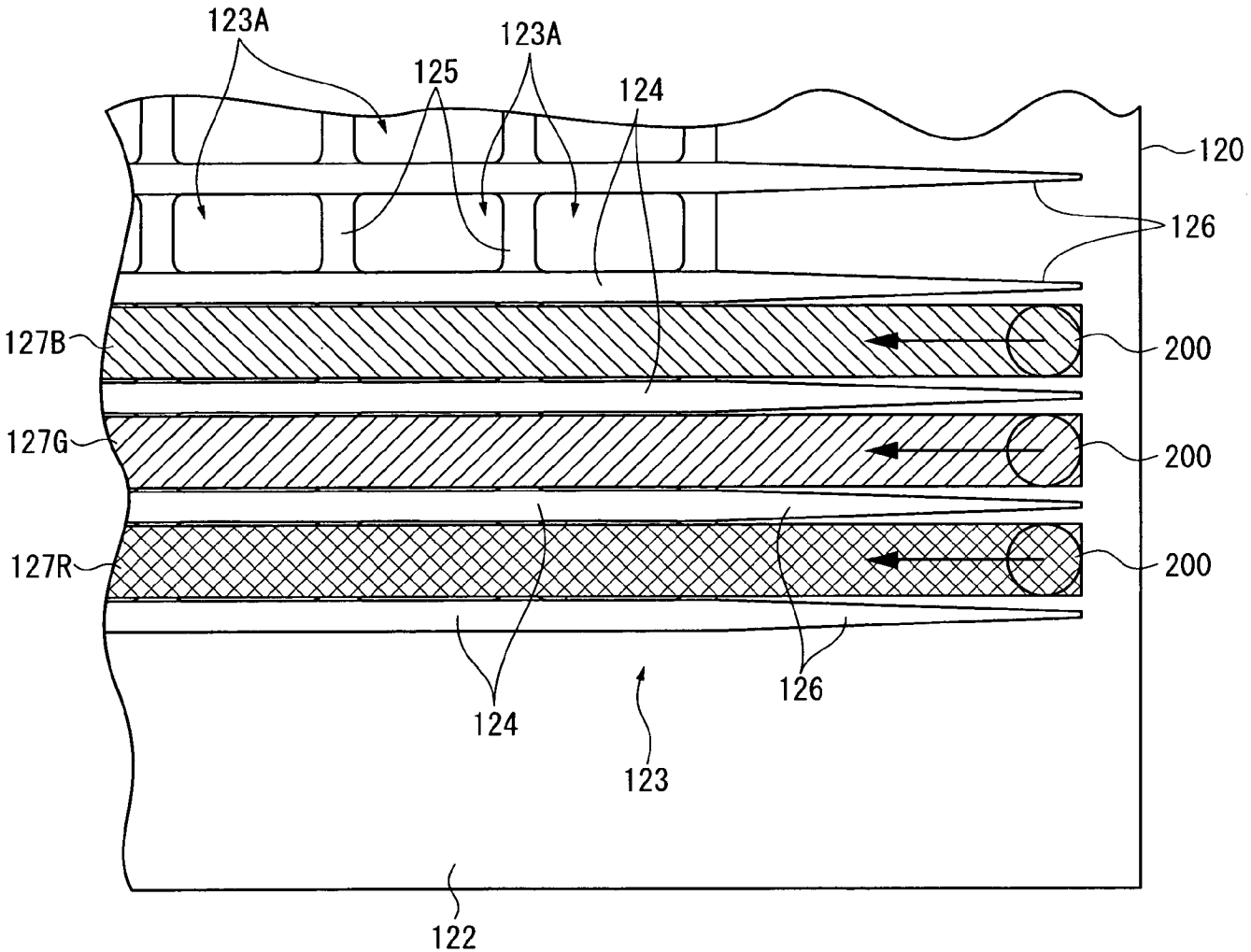
FIG. 7 is a plan view showing a state where the phosphor paste is applied in the phosphor layer forming step according to the first embodiment.

FIG. 6 is a cross-sectional view schematically showing the nozzle for injecting the phosphor paste and the rear substrate in the phosphor layer forming step. FIG. 7 is a plan view showing a state where the phosphor paste is applied in the phosphor layer forming step.

The manufacturing method of the PDP 100 according to the present embodiment includes: a front substrate manufacturing step for manufacturing the front substrate 110; a rear substrate manufacturing step for manufacturing the rear substrate 120; and a superposing step for superposing the front substrate 110 and the rear substrate 120 to manufacture the PDP 100.

In the front substrate manufacturing step, a transparent-electrode-forming material layer is provided on the entirety of the inner side of the front substrate 110, and the transparent electrodes 111A, 111B are formed. Then, linear patterns formed of Ag material are laminated on ends of the transparent electrodes 111A, 111B, and the bus electrodes are formed by calcination of the patterns. Subsequently, a paste pattern of a black inorganic pigment is exemplarily applied between the bus electrodes, whereby the plurality of black stripes 112 are formed by calcination of the paste pattern. Then, a dielectric paste is applied to the front substrate 110 in laminae, whereby the dielectric layer 113 is formed by calcination of the dielectric paste. The protective layer 134 is film-formed on the dielectric layer 113 by vapor deposition, sputtering or the like.

Next, the rear substrate manufacturing step is performed. The rear substrate manufacturing step includes an address electrode forming step, a dielectric layer forming step, a partition forming step and the phosphor layer forming step.

In the address electrode forming step, the address electrode 121 is formed on the rear substrate 120. In the dielectric layer forming step, the address-electrode dielectric layer 122 is formed to cover the address electrode 121.

In the partition forming step, a partition-forming material layer is uniformly applied to the address-electrode dielectric layer 122. Then, a film molding die is exemplarily disposed on the partition-forming material layer, and the partition layer 123 is formed by plastic-deforming the partition-forming material layer using a transfer roller. The molding die has convexes and concaves of predetermined dimensions that correspond to the first partition 124, the second partition 125, the partition end 126 and the recessed portion 123A. By plastic-deforming the partition-forming material layer by the transfer roller, there is provided the partition layer 123 including: the recessed portion with the column width a and the transverse width b; the first partition 124 extending in the width direction; the second partition 125 extending in the column direction; and the partition end 126 formed on the end of the first partition 124, as described above.

In the phosphor layer forming step, the phosphor layer 127 is formed by applying the phosphor paste. In applying the phosphor paste, a nozzle 200 adapted to inject the phosphor paste is used as shown in FIG. 6. The nozzle 200 is adapted to be moved by a scanning mechanism (not shown) in the longitudinal direction of the first partition 124, i.e., the width direction of the PDP 100.

As shown in FIG. 7, at the time of starting the application, the nozzle 200 is located between the neighboring partition ends 126 that face a first non-display area 100B. In the non-display area 100B, the first non-display 100B area and a later-described second non-display area 100B are disposed with the first partition 124 interposed therebetween. Then, the nozzle 20 is moved in the width direction at a constant speed while injecting the phosphor paste at a constant predetermined injection amount. Since the low wall portion 125A is provided to a part of the second partition 125, the phosphor paste does not flow into the recessed portion 123A in the other neighboring lines in the column direction when the nozzle 200 is moved beyond the second partition 125. Thus, the phosphor paste can be stably applied to the recessed portion 123A on the one line that is to be applied with the phosphor paste.

Then, when the nozzle 200 is moved to between the neighboring partition ends 126 that face the second non-display area 100B (i.e., the other non-display area 100B disposed to hold the first partition 124 against the first non-display area 100B in the non-display area 100B), the injection of the phosphor paste is terminated.

At the time of starting and terminating the nozzle movement, even when the phosphor paste is applied in an increased amount due to a decrease in the speed of the nozzle, the phosphor paste is not applied on the top side of the partition end 125 because the width dimension h of the out-of-plane directional end of the partition end 126 is 90 percent or less of the width dimension i of the in-plane directional end such that a volume between the partition ends 126 becomes large.

The above-described operation is performed to apply the phosphor paste substantially all over the rear substrate 120 such that the red phosphor paste, the green phosphor paste and the blue phosphor paste are arranged along the longitudinal direction of the second partition 125 in this order. Although one nozzle 200 is shown in FIG. 6, a plurality of nozzles are simultaneously moved along the first partition 124 in the actual operation as shown in FIG. 7, such that the phosphor pastes of plural colors are simultaneously applied.

Thereafter, a heat-treating step for heat-treating the applied phosphor paste is performed, such that the phosphor layer 127 is formed by calcination.

Subsequently, by performing the superposing step, the front substrate 110 and the rear substrate 120 are superposed to manufacture the PDP 100. Even when a phosphor layer is formed on the top side of the partition end 126 of the rear substrate 120 with the phosphor paste, since the height dimension f of the out-of-plane directional end of the partition end 126 is 94.8 percent or less of the height dimension g of the in-plane directional end, there is no gap provided the front substrate 110 and the rear substrate 120 in the display area 100, whereby a noise due to the discharge can be prevented.

[Effects and Advantages of PDP]

According to the above-described arrangement according to the present embodiment, the following effects and advantages are expected.

(1) In the PDP 100 according to the present embodiment, the end of the first partition 124 is provided with the partition end 126 whose height dimension and width dimension are smaller than those of the first partition 124.

With this arrangement, when the nozzle 200 is moved in the phosphor layer forming step from between first partition ends 126 to between second partition ends 126 (the first partition 124 is interposed between the first and second partition ends 126), the phosphor paste can be uniformly applied to the recessed portions 123A, whereby the stable phosphor layer 127 can be formed. Accordingly, since the summed heights of the partition end 126 and the phosphor layer 127 provided on the top side thereof do not exceed the height of the first partition 124, the noise in the display area 100A of the PDP 100 can be prevented, whereby good images can be displayed.

(2) The height dimension f of the out-of-plane directional end of the partition end 126 is smaller than the height dimension g of the first partition 124.

With this arrangement, even when the phosphor layer is formed on the top side of the partition end 126 with the phosphor paste during the phosphor layer forming step, the sum of the height dimension f from the address-electrode dielectric layer 122 to the top side of the partition end 126 and the dimension of the phosphor paste applied on the top side is not larger than the height dimension g of the first partition 124, so that no gap is provided between the front substrate 110 and the rear substrate 120 in the display area 100A. Accordingly, no noise is generated by a resonance due to the discharge in the discharge space, whereby good images can be reproduced.

In addition, the height dimension f of the out-of-plane directional end is 94.8 percent or less of the height dimension g of the first partition 124. With this arrangement, even when the phosphor paste whose powder proportion to the solvent is 75 percent (a generally used phosphor paste) is applied on the top side of the partition end 126, a sum of the height dimension f of the partition end 126 and the thickness dimension of the phosphor layer 127 does not exceed the height dimension g of the first partition 124, whereby a degradation of image quality due to a noise can be more reliably prevented.

(3) The width dimension h of the out-of-plane directional end of the partition end 126 is equal to or smaller than the width dimension i (the width dimension of the first partition) of the in-plane directional end.

With this arrangement, even when the phosphor paste is injected in an amount more than the predetermined amount, for instance, due to a decrease in the speed of the nozzle 200 in applying the phosphor paste to the portion between the partition ends 126 during the phosphor layer forming step, since the distance between the neighboring partition ends 126 is large, the phosphor paste can be prevented from flowing onto the top side of the partition end 126. Thus, the phosphor layer 127 can be prevented from being formed on the top side of the partition end 126, and no gap is formed between the front substrate 110 and the rear substrate 120 in the display area 100A. Hence, no noise is generated by a resonance due to the discharge in the discharge space, whereby good images can be reproduced.

(4) The longitudinal length dimension e of the end partition 126 is set to be larger than the transverse width b of the recessed portion 123A.

With this arrangement, when the nozzle 200 is started to be moved from between the neighboring partition ends 126 facing the first non-display area 100B during the phosphor layer forming step, a sufficient acceleration distance for the nozzle 200 can be secured. Thus, when the phosphor paste is applied to the recessed portions 123A along between the neighboring first partitions 124, the movement speed of the nozzle 200 can be reliably set to be constant, whereby the stable phosphor layer 127 can be formed.

(5) The second partition 125 that bridges the first partitions 124 is partially provided with the low wall portion 125A whose height dimension is smaller than that of the first partition 124.

With this arrangement, even when the phosphor paste is continuously injected to the portion between the neighboring first partitions 124 along the first partition 124, the phosphor paste having been injected onto the top side of the second partition 125 flows from the low wall portion 125A into the recessed portion 123A in the line in which the phosphor paste is being applied. Thus, the phosphor paste can be prevented from flowing into the other lines that neighbors the line in which the phosphor paste is being applied, whereby fluorescence colors of the phosphor pastes can be prevented from being mixed. Hence, the PDP 100 that can display good images can be provided.

(6) In the phosphor layer forming step, the nozzle 200 is located between the neighboring partition ends 126 that face the first non-display area 100B (the pair of first non-display area 100B and second non-display area 100B are disposed with the display area 100A being interposed therebetween). Then, while the nozzle 200 is moved at the predetermined constant speed from this starting position toward between the neighboring partition ends 126 disposed to face the second non-display area 100B, the nozzle 200 injects the phosphor paste for forming the phosphor layer 127 whose end reaches the partition ends 126.

With this arrangement, the phosphor paste can be uniformly applied to the recessed portion 123A between the first partitions 124, whereby the stable phosphor layer 127 is formed in the recessed portions 123A disposed in the display area 100A to correspond to the discharge cells.

(7) In the phosphor layer forming step, the red phosphor paste, the green phosphor paste and the blue phosphor paste are applied to the lines between the first partitions 124 such that the red phosphor layer 127R, the green phosphor layer 127G and the blue phosphor layer 127B are arrayed in this order along the longitudinal direction of the second partition 125. As described above, since the phosphor paste is applied along the line between the first partitions 124, the phosphor paste does not flow into the other neighboring lines. Accordingly, the applied red phosphor paste, green phosphor paste and blue phosphor paste can be simultaneously dried or calcinated, thereby improving an operation efficiency in the phosphor layer forming step.

Other Embodiments

It should be noted that the present invention is not limited to the embodiments described above but includes modifications, improvements and the like within a scope where an object of the present invention can be achieved.

For instance, although the curb-shaped partition is formed in the rear substrate 120 by the first partition 124 and the second partition 125 that are perpendicular to each other in the above-described embodiment, the present invention is not limited thereto but may adopt an arrangement in which only the first partition 124 and the partition end 126 form a striped partition.

In addition, although the partition end 126 is exemplarily configured such that the height dimension f of the out-of-plane directional end is smaller than the height dimension g of the in-plane directional end (the height dimension of the first partition 124) while the width dimension h of the out-of-plane directional end is smaller than the width dimension i of the in-plane directional end (the width dimension of the first partition 124) in the above-described embodiment, the partition end 126 may be configured to, for example, satisfy either one of the above-described conditions. Specifically, the partition end 126 may be configured such that the height dimension f of the out-of-plane directional end is smaller than the height dimension g of the in-plane directional end while the width dimensions of the out-of-plane directional end and the in-plane directional end are substantially the same. Conversely, the partition end 126 may be configured such that the width dimension h of the out-of-plane directional end is smaller than the width dimension i of the in-plane directional end while the height dimensions of the out-of-plane directional end and the in-plane directional end are substantially the same.

Figure 8A:
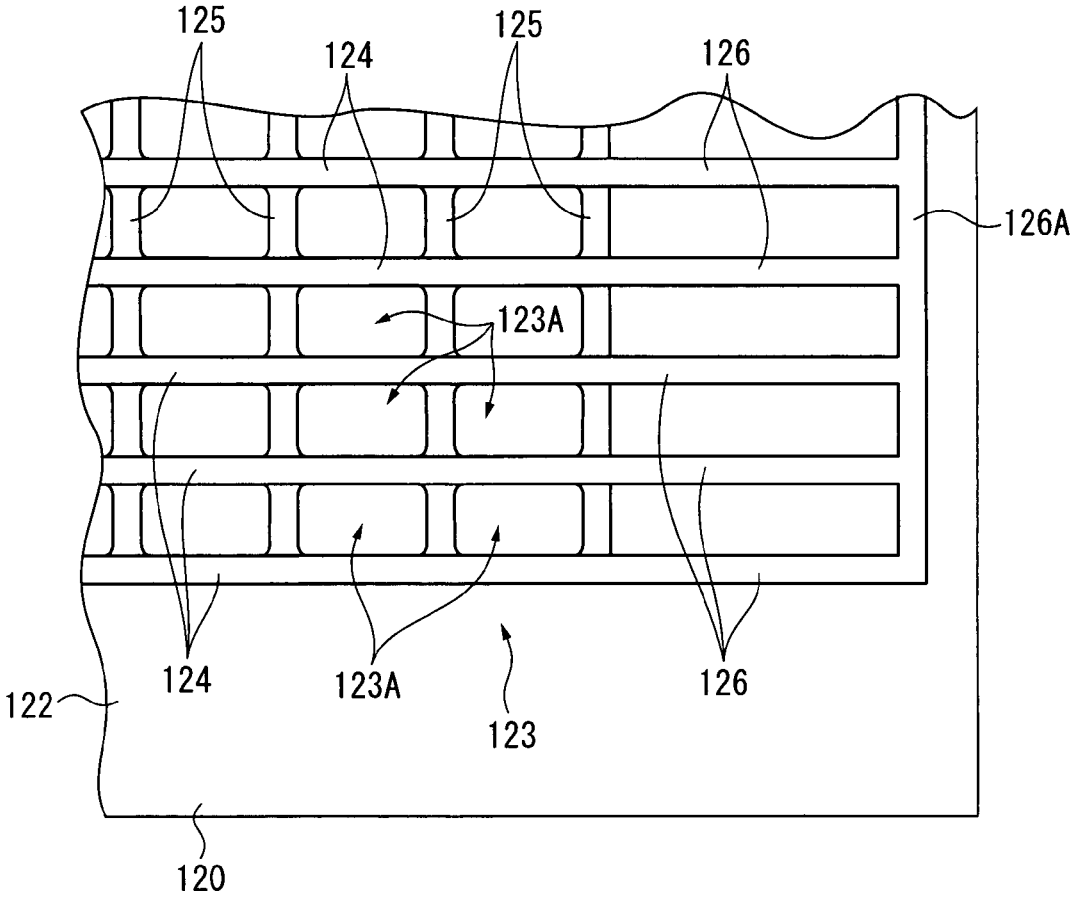
FIG. 8A is a plan view showing a vicinity of an end of a rear substrate according to a second embodiment.
Figure 8B:
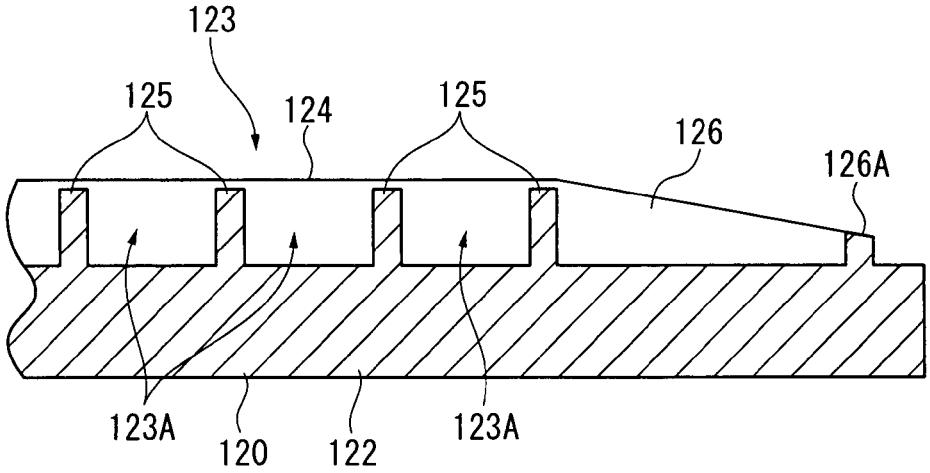
FIG. 8B is a cross-sectional view showing the vicinity of the end of the rear substrate according to the second embodiment.
Figure 9A:
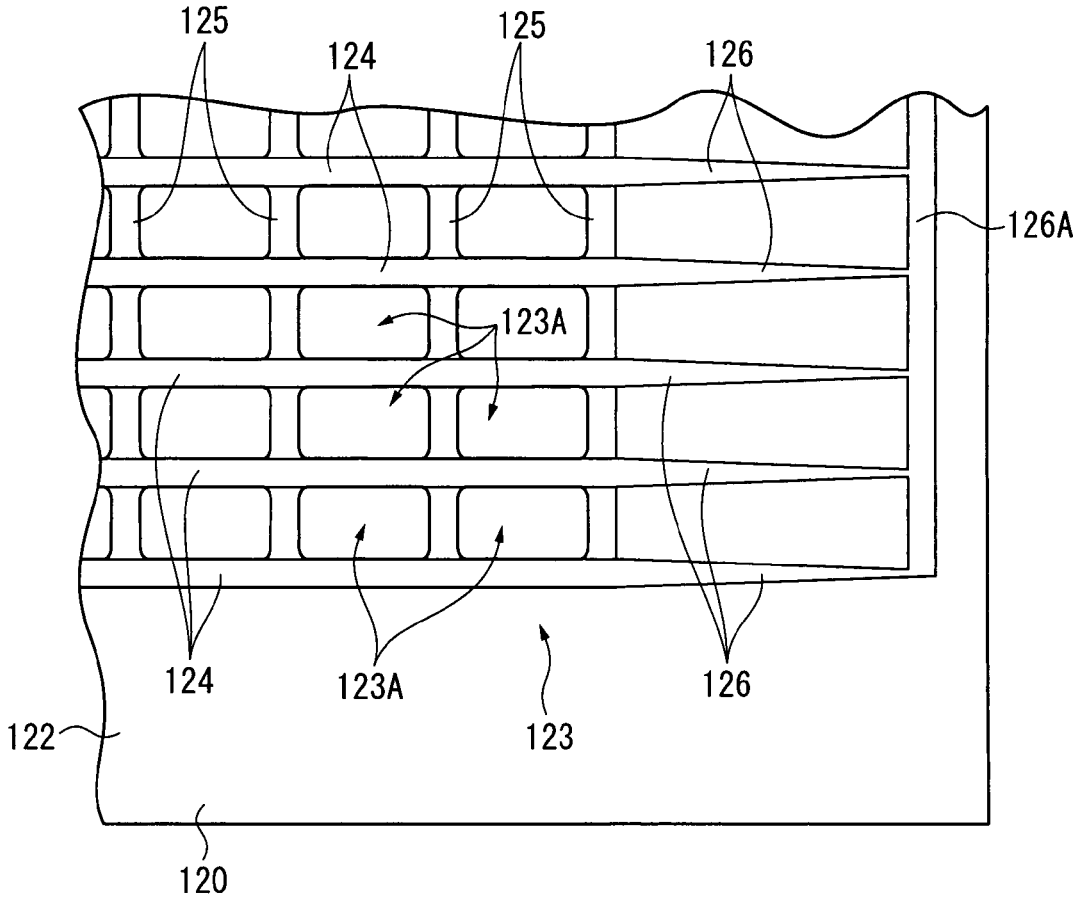
FIG. 9A is a plan view showing a vicinity of an end of a rear substrate according to a third embodiment.
Figure 9B:
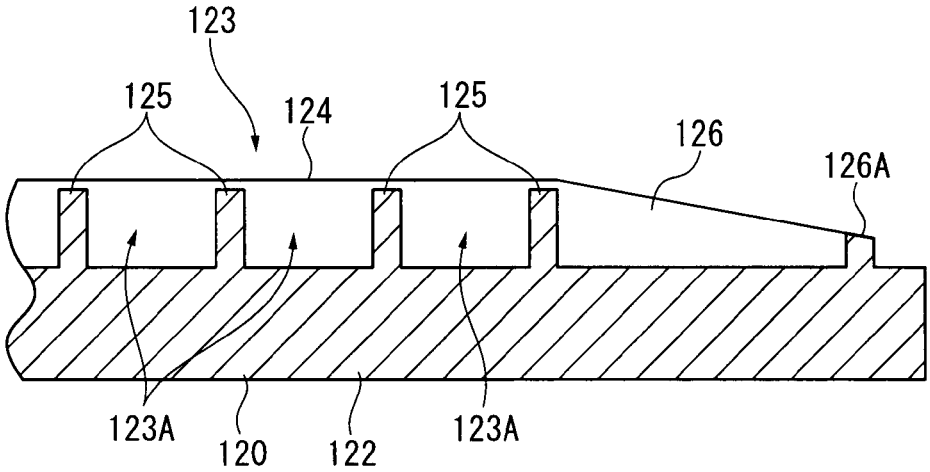
FIG. 9B is a cross-sectional view showing the vicinity of the end of the rear substrate according to the third embodiment.

Further, as shown in FIGS. 8A and 8B, a connecting wall 126A for connecting the out-of-plane directional ends of the partition ends 126 may be provided. The connecting wall 126A is configured such that a height dimension of the connecting wall 126A equals to the height dimension f of the out-of-plane directional end of the partition end 126. By providing the above-described connecting wall 126A, the phosphor paste can be prevented from flowing from the end periphery of the rear substrate 120 when the phosphor paste is applied during the phosphor layer forming step, whereby the rear substrate 120 can be prevented from being partially contaminated by the phosphor paste having outflowed. As shown in FIGS. 9A and 9B, by configuring the partition end 126 such that the width dimension is reduced from the in-plane side toward the out-of-plane side, the phosphor layer can be reliably prevented from being formed on the top side of the partition end 126 as described above.

Figure 10A:
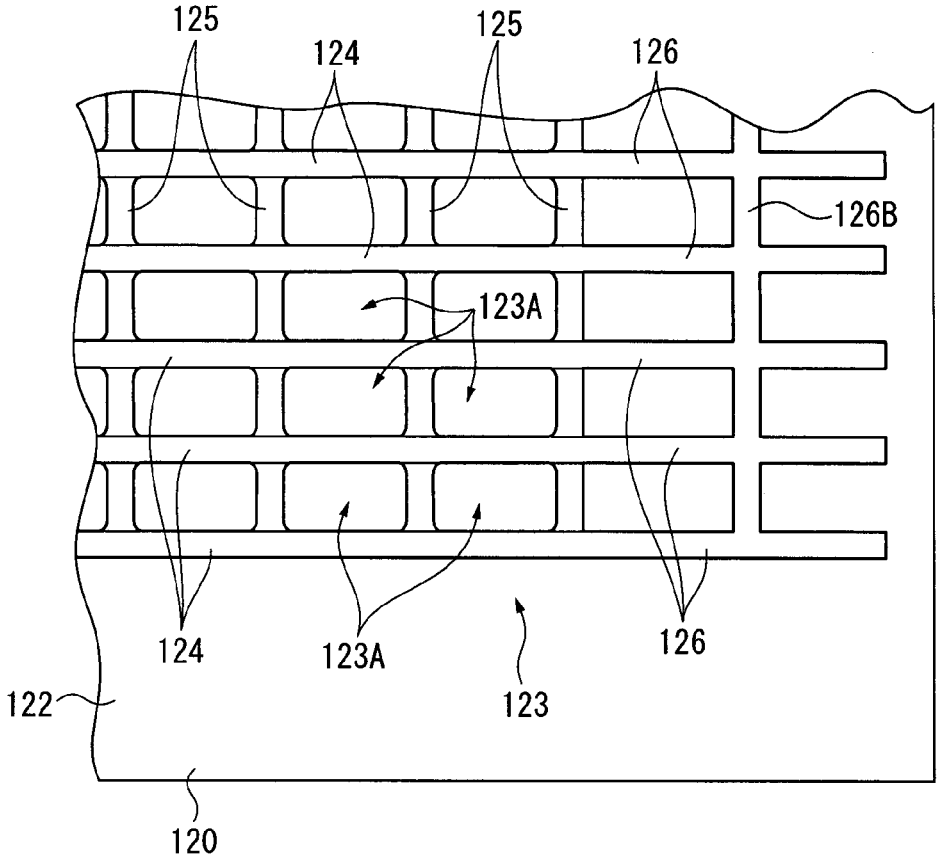
FIG. 10A is a plan view showing a vicinity of an end of a rear substrate according to a fourth embodiment.
Figure 10B:
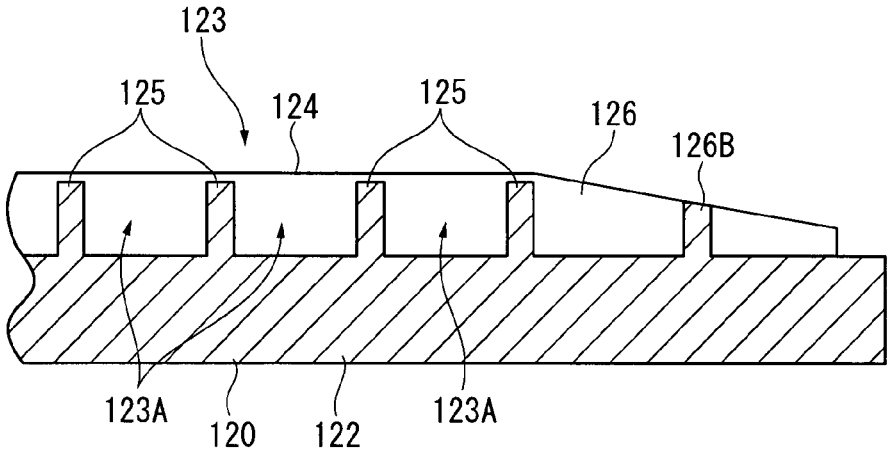
FIG. 10B is a cross-sectional view showing the vicinity of the end of the rear substrate according to the fourth embodiment.
Figure 11A:
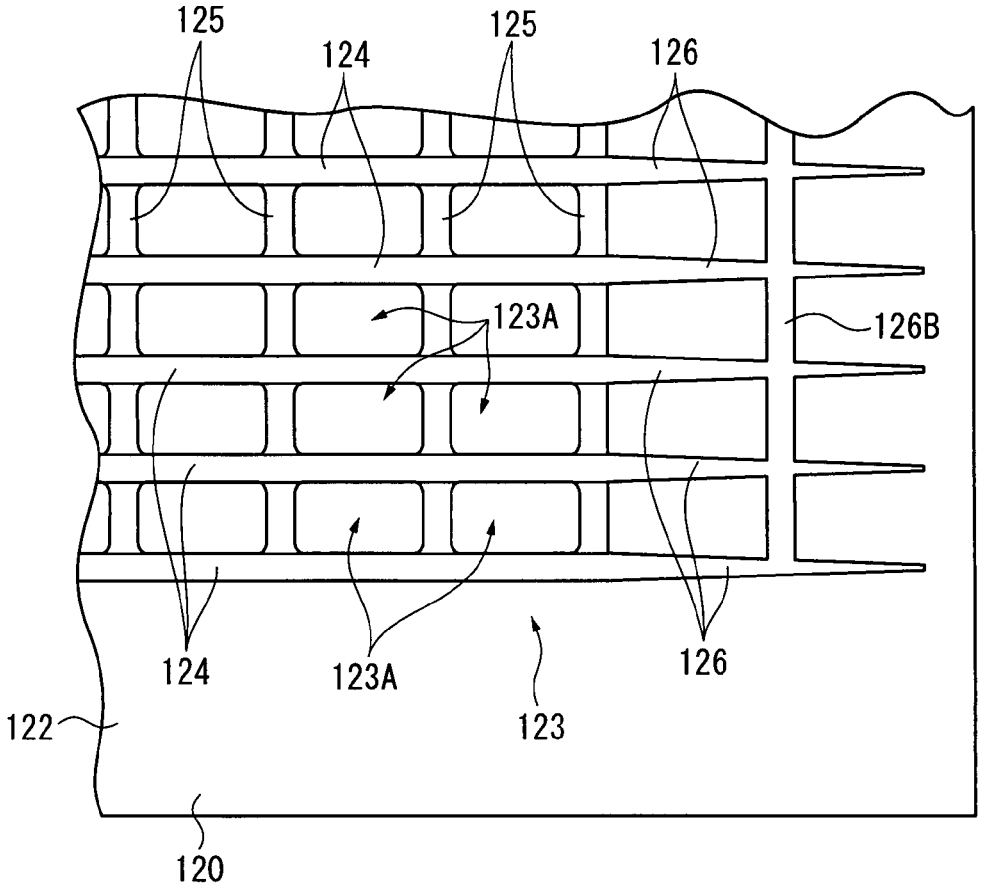
FIG. 11A is a plan view showing an end of a rear substrate according to a fifth embodiment.
Figure 11B:
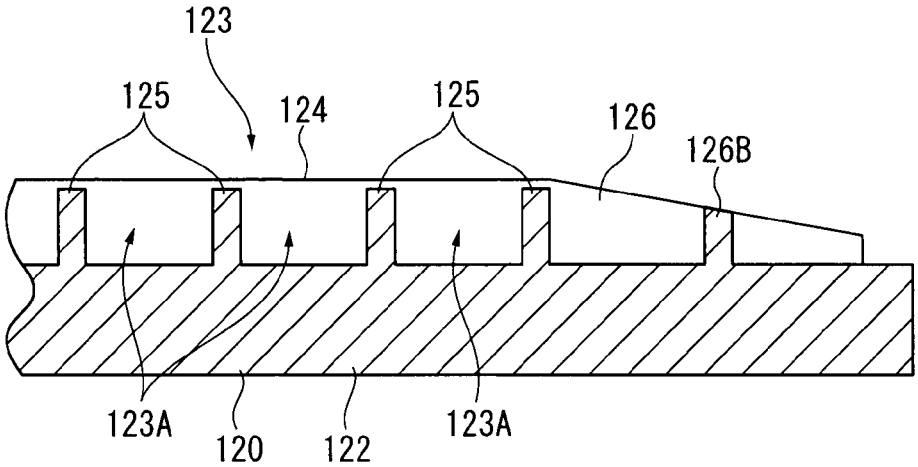
FIG. 11B is a cross-sectional view showing the vicinity of the end of the rear substrate according to the fifth embodiment.

Further, as shown in FIGS. 10A and 10B, a partition-end connecting wall 126B for connecting the neighboring partition ends 126 may be provided at a middle position of the longitudinal direction of the partition end 126. The partition-end connecting wall 126B is arranged to be substantially as high as a connection position of the partition end 126. With this arrangement, in an operation to form the phosphor layer 127 by heat-treating the phosphor paste for calcination during the phosphor layer forming step, the partition end 126 is prevented from being tumbled to be damaged due to the heat. As shown in FIGS. 11A and 11B, by configuring the partition end 126 such that the width dimension is reduced from the in-plane side toward the out-of-plane side, the phosphor layer can be reliably prevented from being formed on the top side of the partition end 126 as described above.

Figure 12A:
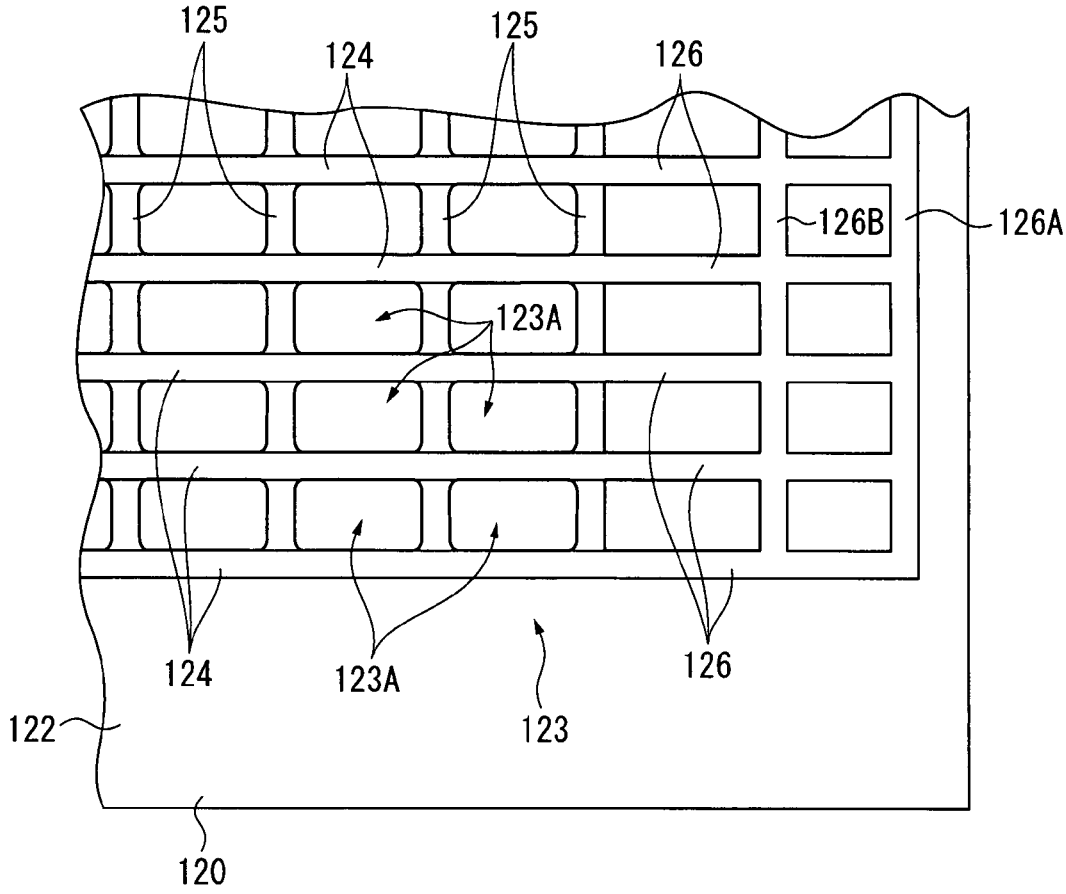
FIG. 12A is a plan view showing an end of a rear substrate according to a sixth embodiment.
Figure 12B:
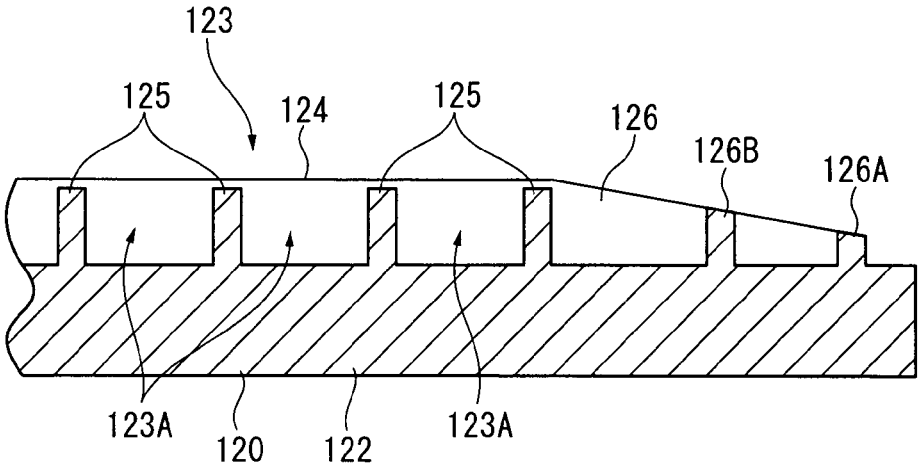
FIG. 12B is a cross-sectional view showing the vicinity of the end of the rear substrate according to the sixth embodiment.
Figure 13A:
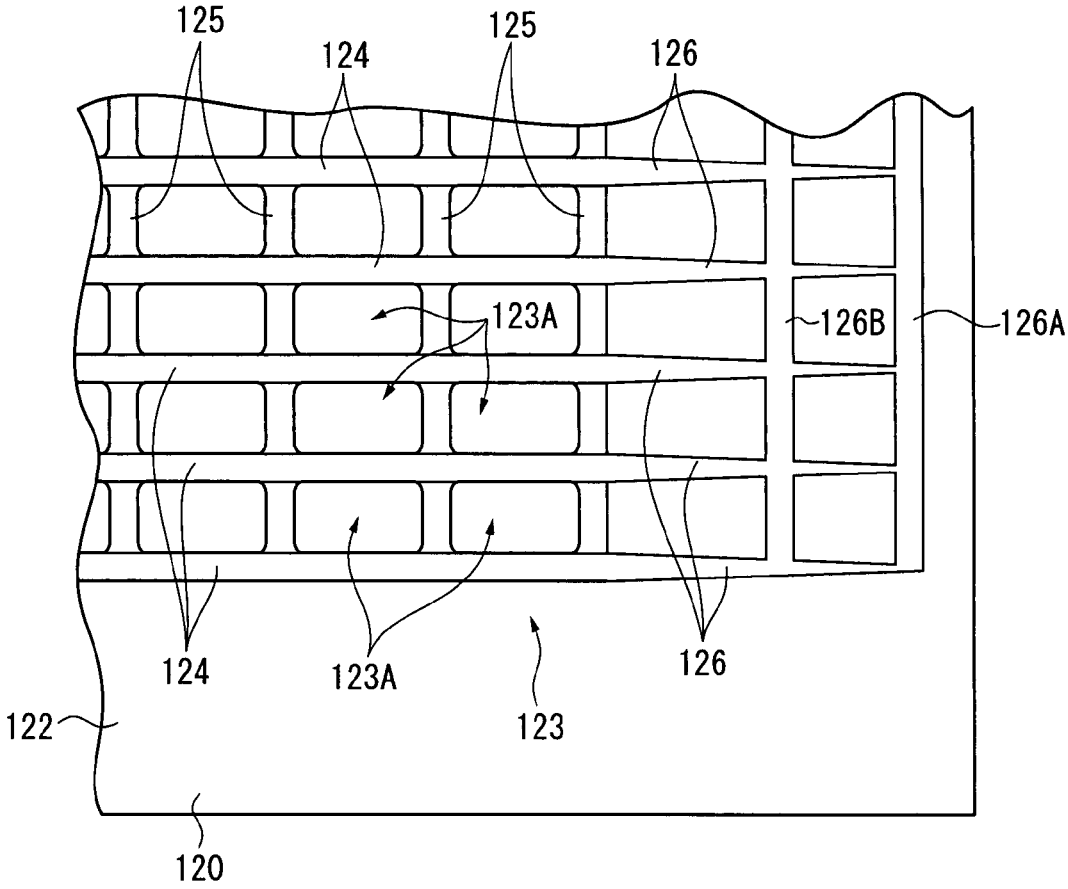
FIG. 13A is a plan view showing an end of a rear substrate according to a seventh embodiment.
Figure 13B:
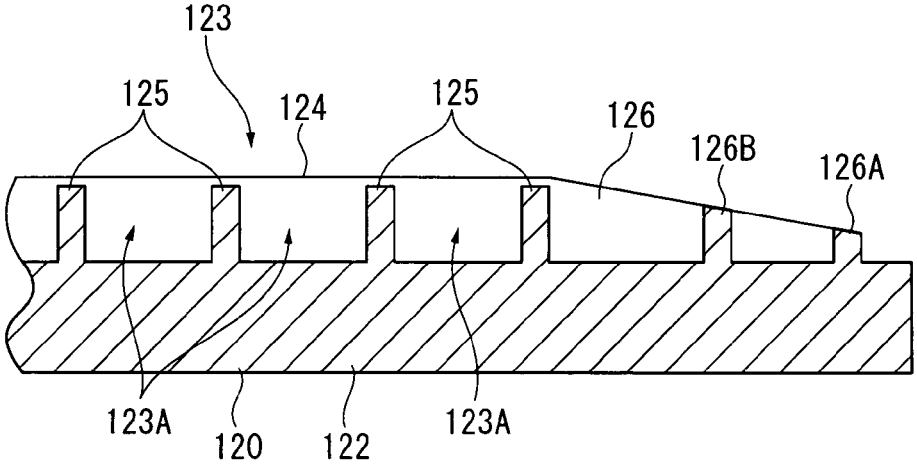
FIG. 13B is a cross-sectional view showing the vicinity of the end of the rear substrate according to the seventh embodiment.

Further, as shown in FIGS. 12A and 12B, additionally to the connecting wall 126A for connecting the out-of-plane directional ends of the partition ends 126, the partition-end connecting wall 126B for connecting the partition ends 126 may be provided at the middle position of the longitudinal direction of the partition end 126. With this arrangement, the phosphor paste can be prevented from outflowing from the end periphery of the rear substrate 120 during the phosphor layer forming step, and the partition end 126 can be prevented from being tumbled to be damaged due to the heat. As shown in FIGS. 13A and 13B, by configuring the partition end 126 such that the width dimension is reduced from the in-plane side toward the out-of-plane side, the phosphor layer can be reliably prevented from being formed on the top side of the partition end 126 as described above.

Although the partition end 126 is provided on the extension of the first partition 124 that is formed substantially in the same direction as the width direction of the PDP 100 while the phosphor layer 127 is formed along the line between the first partitions 124 in the above-described embodiments, for example, the partition end 126 may be formed on the extension of the second partition 125 that is formed substantially in the same direction as the column direction of the PDP 100 while the phosphor layer 127 may be formed along the line between the second partitions 125.

Effects and Advantages of Embodiments

As described above, in the PDP 100 according to the above-described embodiments, the end of the first partition 124 is provided with the partition end 126 whose height dimension and width dimension are smaller than those of the first partition 124.

With this arrangement, when the nozzle 200 is moved in the phosphor layer forming step from the portion between the partition ends 126 on the one side to the portion between the partition ends 126 on the other side with the first partition 124 being interposed between the portions, the phosphor paste can be uniformly applied to the recessed portions 123A, whereby the stable phosphor layer 127 can be formed. Accordingly, since the partition end 126 and the phosphor layer 127 provided on the top side thereof do not exceed the height of the first partition 124, the noise in the display area 100A of the PDP 100 can be prevented, whereby good images can be displayed.

The priority application Number JP2006-341594 upon which this patent application is based is hereby incorporated by reference.

What is claimed is:

1. A display panel, comprising:

a pair of substrates disposed to face each other with a discharge space being interposed;

partitions that partition the discharge space into display cells, the partitions being provided to at least one of the pair of substrates to be formed in a longitudinal direction between ends of the at least one of the pair of substrates; and a phosphor layer that emits light due to discharge in the discharge space, the phosphor layer being formed between the partitions, wherein a display area in which images are displayed by light emitting of the phosphor layer due to the discharge is provided in an in-plane side of the at least one of the substrates while a non-display area is provided at a peripheral end of the at least one of the substrates, a first height dimension of an end of each of the partitions provided at positions corresponding to the non-display area is at least partially smaller than a second height dimension of each of the partitions provided at positions corresponding to the display area, the first and second height dimensions being dimensions of heights measured in a direction perpendicular to a surface of the at least one of the substrates, a first width dimension of the end of each of the partitions provided at the positions corresponding to the non-display area is at least partially smaller than a second width dimension of each of the partitions provided at the positions corresponding to the display area, the first and second width dimensions being dimensions of widths that are substantially perpendicular to the longitudinal direction of the partitions and substantially perpendicular to the height dimensions, and an end of the phosphor layer is formed between the ends of the partitions provided at the positions corresponding to the non-display area.

2. The display panel according to claim 1, wherein a first length dimension of the end of each of the partitions provided at the positions corresponding to the non-display area is equal to or larger than a second length dimension of each of the display cells, the first length dimension being a dimension of a length extending in a longitudinal direction of the at least one of the substrates , the second length being a dimension of a length extending in a direction substantially parallel to the longitudinal direction of the partitions.

3. The display panel according to claim 1, wherein each of the partitions includes: a first partition that partitions the discharge space in a first direction; and a second partition that partitions the discharge space in a second direction substantially perpendicular to the first direction, and the end of the phosphor layer is formed between ends of the first partitions provided at the positions corresponding to the non-display area.

4. The display panel according to claim 3, wherein the phosphor layer includes a plurality of partial phosphor layers whose colors are different from one another, and the partial phosphor layers are continuously provided between the first partitions along the first direction.

5. The display panel according to claim 3, wherein the second partition includes a low partition portion between the first partitions that neighbors each other, a height dimension of the low partition portion from the at least one of the substrates being lower than a height dimension of the first partition from the at least one of the substrates.

* * * * *